US009601849B2

(12) United States Patent
Hirakawa

(10) Patent No.: US 9,601,849 B2
(45) Date of Patent: Mar. 21, 2017

(54) SUBSTRATE-CONNECTING ELECTRIC CONNECTOR AND SUBSTRATE-CONNECTING ELECTRIC CONNECTOR DEVICE

(71) Applicant: DAI-ICHI SEIKO CO., LTD., Kyoto-shi (JP)

(72) Inventor: Takeshi Hirakawa, Tokyo (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 14/934,688

(22) Filed: Nov. 6, 2015

(65) Prior Publication Data

US 2016/0141783 A1 May 19, 2016

(30) Foreign Application Priority Data

Nov. 14, 2014 (JP) ..... 2014-232189

(51) Int. Cl.
*H01R 13/631* (2006.01)
*H01R 12/70* (2011.01)
(Continued)

(52) U.S. Cl.
CPC ..... *H01R 12/7076* (2013.01); *H01R 12/716* (2013.01); *H01R 13/6275* (2013.01)

(58) Field of Classification Search
CPC .. H01R 23/725; H01R 13/631; H01R 13/465; H01R 9/096; H01R 13/629; H01R 13/641
(Continued)

(56) References Cited

U.S. PATENT DOCUMENTS 8,845,339 B2 * 9/2014 Ono ..... H01R 12/7052 439/74
9,039,428 B2 * 5/2015 Sasaki ..... H01R 12/716 439/74
(Continued)

FOREIGN PATENT DOCUMENTS

CN 1731627 A 2/2006
CN 103098307 A 5/2013
(Continued)

OTHER PUBLICATIONS

Japanese Office Action issued Aug. 31, 2016 in Patent Application No. 2014-232189.
(Continued)

*Primary Examiner* — Gary Paumen
(74) *Attorney, Agent, or Firm* — Oblon, McClelland, Maier & Neustadt, L.L.P.

(57) ABSTRACT

A smooth mating operation is enabled by a simple configuration in a state in which electric connectors are easily and reliably positioned. A plug-side mating guide member made of metal projecting to an outer side from a wiring substrate is provided with guide surfaces, which contact part of a counterpart connector and slide so as to carry out positioning of a mating operation. Apart from which the plug-side mating guide member projects from the wiring substrate is directly or indirectly checked visually. As a result, the mating operation can be carried out while approximating the mutual mating positional relation of both of the electric connectors, and the mating positional relation is regulated to a predetermined state by guiding actions of the guide surfaces of the plug-side mating guide member so that the mutual mating operation of the electric connectors is easily and precisely carried out.

8 Claims, 21 Drawing Sheets

(51) Int. Cl.
*H01R 12/71* (2011.01)
*H01R 13/627* (2006.01)

(58) Field of Classification Search
USPC ..... 439/374, 74, 488
See application file for complete search history.

(56) References Cited

U.S. PATENT DOCUMENTS

| | | | | |
|---|---|---|---|---|
| 2005/0009383 | A1* | 1/2005 | Okura | H01R 13/6275 439/74 |
| 2012/0178284 | A1* | 7/2012 | Wang | H01R 13/502 439/488 |
| 2015/0140841 | A1* | 5/2015 | Watanabe | H01R 12/7011 439/74 |

FOREIGN PATENT DOCUMENTS

| | | | |
|---|---|---|---|
| JP | 2013-101909 | A | 5/2013 |
| JP | 2013-125624 | | 6/2013 |
| JP | 2013-161578 | | 8/2013 |
| JP | 2013-232386 | A | 11/2013 |
| JP | 2014-212049 | A | 11/2014 |

OTHER PUBLICATIONS

Office Action issued Sep. 9, 2016, in Taiwanese Patent Application No. 104130708.

* cited by examiner

SUBSTRATE-CONNECTING ELECTRIC CONNECTOR AND SUBSTRATE-CONNECTING ELECTRIC CONNECTOR DEVICE

BACKGROUND OF THE INVENTION

Field of the Invention

The present invention relates to a substrate-connecting electric connector that is mated with a counterpart connector in a state in which it is mounted on a wiring substrate and to a substrate-connecting electric connector device.

Description of the Related Art

Generally, in various electric equipment, for example, a substrate-connecting electric connector device referred to as a stacking connector that electrically connects paired wiring substrates to each other has been widely employed. The substrate-connecting electric connector device of this type is configured to dispose, for example, a second electric connector to which a second wiring substrate is coupled above a first electric connector to which a first wiring substrate is coupled so that the second electric connector faces thereto, cause both of the electric connectors to be a mutually mated state by lowering and pushing in the second electric connector in the upper side toward the first electric connector in the lower side from that facing state, and electrically connect the first and second wiring substrates to each other. When mating of both of the electric connectors to each other is to be carried out in this manner, one of the electric connectors is caused to be in a vertically flipped state, thereby disposing both of the electric connectors to face each other.

However, in a general substrate-connecting electric connector device, when one of electric connectors is vertically flipped and disposed in the above described manner, a wiring substrate on which the flipped and disposed electric connector is mounted is positioned above the electric connector, and the entire electric connector is therefore in a state in which it is covered and concealed from the upper side by the wiring substrate. Therefore, at which position the upper-side electric connector is positioned with respect to the electric connector disposed in the lower side cannot be checked, and a mating operation may be carried out in a state in which both of the electric connectors are not in mutually appropriate mating positions. When the mating operation is carried out in the state in which both of the electric connectors are not in the mutually appropriate mating positions in such a manner, both of the electric connectors are not sufficiently mated with each other, and it is conceivable that the mating operation is completed in a so-called half-mated state. In such a case, insufficient conduction may be caused by the shock, etc. that occurs during usage of the equipment.

On the other hand, a substrate-connecting electric connector device disclosed in Japanese Unexamined Patent Application Publication No. 2013-161578 described below employs a configuration in which part of unlock operation parts are projected to an outer side from longitudinal-direction both end portions of an upper-side electric connector so that the part of the unlock operation parts can be visually checked from the upper side. According to such a configuration, the mating position of the electric connector in the upper side with respect to the counterpart connector in the lower side can be visually checked. However, the substrate-connecting electric connector device is not provided with a mating-position regulating means which functions so as to precisely position the mutual mating positions of both of the electric connectors. Therefore, there is still a risk of occurrence of mutual interference and damage of both of the electric connectors in the mutual mating operation of both of the electric connectors; and, if mating is carried out in a state in which the mating positions are misaligned, the unlock operation parts formed of resin may be broken due to interference with fixing fittings.

We disclose Japanese Unexamined Patent Application Publication No. 2013-161578 as examples of related art.

SUMMARY OF THE INVENTION

Therefore, it is an object of the present invention to provide substrate-connecting electric connectors and a substrate-connecting electric connector device that enable easy and reliable mutual positioning of both of electric connectors and enable a smooth mating operation without damaging the connectors by a simple configuration even if mating is carried out in a state in which mating positions are somewhat misaligned.

The invention according to a first aspect for achieving the above described object employs a configuration of a substrate-connecting electric connector configured so as to be mated with a counterpart connector in a state in which the electric connector is mounted on a wiring substrate, the substrate-connecting electric connector having a mating guide member(s) made of metal that regulates a position of mating with the counterpart connector and is provided so as to project toward an outer side from an end edge portion forming an outer shape of the wiring substrate; and the mating guide member has a guide surface that contacts part of the counterpart connector and slides toward a predetermined position upon mating with the counterpart connector.

According to the substrate-connecting electric connector provided with such a configuration according to the first aspect, a mating operation is carried out while the mutual mating position relation of both of the electric connectors is approximated by directly or indirectly visually checking the part of the mating guide member projecting from the end edge portion forming the outer shape of the wiring substrate. When the mating operation is completed, the mutual mating position relation of the electric connectors is regulated to a predetermined state by the guiding actions based on sliding of the guide surface of the mating guide member, and the mutual mating operation of the electric connectors is easily and precisely carried out.

Herein, according to the invention according to a second aspect, the guide surface may be formed by a curved surface or a tilted surface.

According to the invention according to a third aspect, it is desired that the mating guide members be attached respectively to longitudinal-direction both end parts of an insulating housing; and the guide surface be extended in an approximately U-shape in plane so as to cover each of the longitudinal-direction both end parts of the insulating housing from the outer side.

According to the substrate-connecting electric connector provided with such a configuration according to the third aspect like this, the guiding action based on sliding of the guide surface of the mating guide member is reliably carried out across the parts corresponding to the three sides of the U-shape in plane to which the guide surface is extended.

According to the invention according to a fourth aspect, it is desired that each of the longitudinal-direction both end parts of the insulating housing be disposed so as to be overlapped with the guide surface; and an outer shape of each of the longitudinal-direction both end parts of the insulating housing is extended along an outer shape of the guide surface or an inner region thereof.

According to the substrate-connecting electric connector provided with such a configuration according to the fourth aspect like this, each of the outer shapes of the both end parts of the insulating housing is overlapped with the outer shape of the mating guide member or the inner region thereof. Therefore, the outer shape of the mating guide member projects to the outer side of the wiring substrate, and, upon mutual mating of both of the electric connectors, the mutual mating positions of both of the electric connectors can be easily checked by visually checking the outer shape of the mating guide member.

Furthermore, according to the invention according to a fifth aspect, the mating guide member may have a cover surface continuously extended from the guide surface so as to cover each of the longitudinal-direction both end parts of the insulating housing; and the cover surface may have a cover principal surface that is disposed so as to face the counterpart connector upon mating with the counterpart connector, a cover end surface that covers a longitudinal-direction end surface of the insulating housing, and cover lateral surfaces that cover housing-width-direction both end surfaces of the insulating housing, the housing width direction being orthogonal to the longitudinal direction of the insulating housing.

According to the invention according to a sixth aspect, it is desired that the mating guide member be integrally provided with a substrate connecting portion by bending of the guide member, the substrate connecting portion being solder-joined with the wiring substrate; the substrate connecting portion be formed so as to form a plate-shaped member rising approximately perpendicularly from a surface of the wiring substrate; and a surface forming a plate thickness of the substrate connecting portion be configured to contact the surface of the wiring substrate.

According to the substrate-connecting electric connector provided with such a configuration according to the sixth aspect like this, the plate-shaped member forming the substrate connecting portion is disposed so as to rise from the wiring substrate. Therefore, the bending rigidity against the external force applied to the substrate connecting portion upon mutual mating/removal of both of the electric connectors is improved, and the risk that the substrate connecting portion may be peeled off from the wiring substrate particularly upon mutual removal of both of the electric connectors is reduced.

Furthermore, according to the invention according to a seventh aspect, a substrate-connecting electric connector device having the substrate-connecting electric connector according to in any of first to sixth aspects and the counterpart connector mated with the substrate-connecting electric connector; wherein it is desired that the counterpart connector be provided with a counterpart-side mating guide member mated with the mating guide member; and the counterpart-side mating guide member have a counterpart-side guide surface that guides the mating guide member toward an inner-side region of the counterpart-side mating guide member in a plane orthogonal to a direction of mating.

According to the substrate-connecting electric connector device provided with such a configuration according to the seventh aspect like this, the mutual mating operation of the electric connectors can be more easily and precisely carried out by the guiding actions of both of the mating guide member and the counterpart-side mating guide member.

Furthermore, according to the invention according to an eighth aspect, it is desired that the counterpart-side mating guide member be provided with an elastic tongue that elastically contacts the mating guide member.

According to the invention according to a ninth aspect, it is desired that part of the substrate-connecting electric connector described in any of first to sixth aspects and part of the counterpart connector mated with the substrate-connecting electric connector have mutually different colors or hues.

According to the substrate-connecting electric connector device provided with the configuration according to the ninth aspect like this, the relative positional relation in the mutual mating operation of both of the electric connectors is immediately visually checked by the different colors, and the mutual mating operation of both of the electric connectors is further easily and precisely carried out.

As described above, the substrate-connecting electric connector and the substrate-connecting electric connector device according to the present invention is configured to provide the mating guide member made of metal, which is projecting to the outer side from the wiring substrate, with the guide surface, which contacts part of the counterpart connector and slides so as to carry out positioning of the mating operation, enable the mating operation while the mutual mating position relation of both of the electric connectors is approximated by directly or indirectly visually checking the part of the mating guide member projecting from the wiring substrate, and regulate the mating position relation to the predetermined state by the guiding action based on the sliding of the guide surface of the mating guide member, thereby easily and precisely carrying out the mutual mating operation of the electric connectors. By the simple configuration, the mating operation can be carried out smoothly in the state in which both of the electric connectors are easily and reliably positioned mutually, the connectors are not broken even when the mating is carried out in the state in which the mating positions are somewhat misaligned, and the reliability of the substrate-connecting electric connector and the substrate-connecting electric connector device can be significantly increased with low cost.

BRIEF DESCRIPTION OF THE DRAWINGS

FIG. 7 shows, in an enlarged manner, a single mating guide member used in the first electric connector (plug connector) according to the embodiment of the present invention shown in FIG. 1 to FIG. 6; wherein.

FIG. 16 shows, in an enlarged manner, a single counterpart-side mating guide member used in the second electric connector (receptacle connector) according to the embodiment of the present invention shown in FIG. 11 to FIG. 15; wherein.

DETAILED DESCRIPTION OF THE INVENTION

Hereinafter, an embodiment in which the present invention is applied to a substrate-connecting electric connector device, which mutually connects printed wiring substrates, will be explained in detail based on drawings.

[About Overall Structure of Electric Connector Device]

The substrate-connecting electric connector device according to the embodiment of the present invention shown in FIG. 1 to FIG. 22 is used to electrically and mutually connect printed wiring substrates disposed in an electronic device of various types such as a mobile phone, a smartphone, or a tablet-type computer and consists of a plug connector 10 serving as a first electric connector shown in FIG. 1 to FIG. 10 and a receptacle connector 20 serving as a second electric connector shown in FIG. 11 to FIG. 16. When the plug connector 10 is mated with the receptacle connector 20 in a state in which the plug connector (first electric connector) 10 is mounted on a first wiring substrate P1 and the receptacle connector (second electric connector) 20 is mounted on a second wiring substrate P2, the first and second wiring substrates P1 and P2 are electrically connected mutually.

Figure 17:
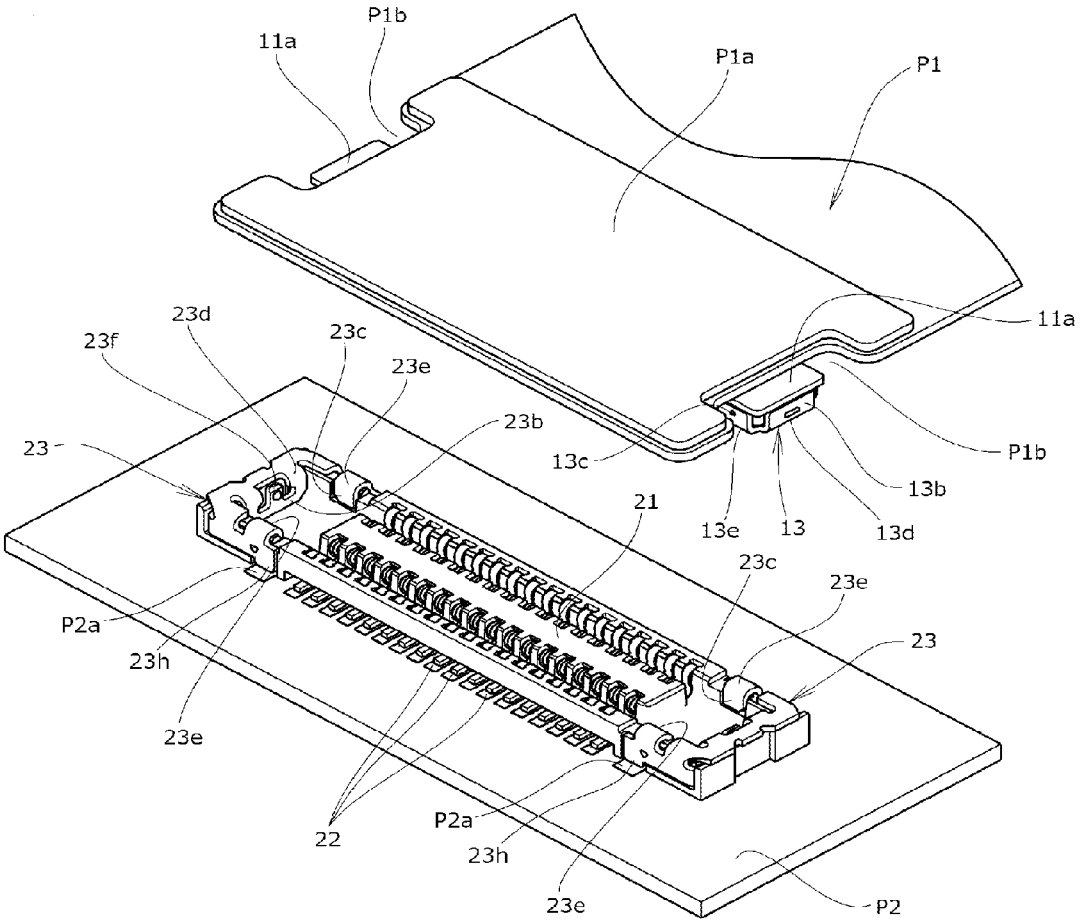
FIG. 17 is an appearance explanatory perspective view showing a state in which the first electric connector (plug connector) is vertically flipped and disposed to face an upper position of the second electric connector (receptacle connector)
Figure 18:
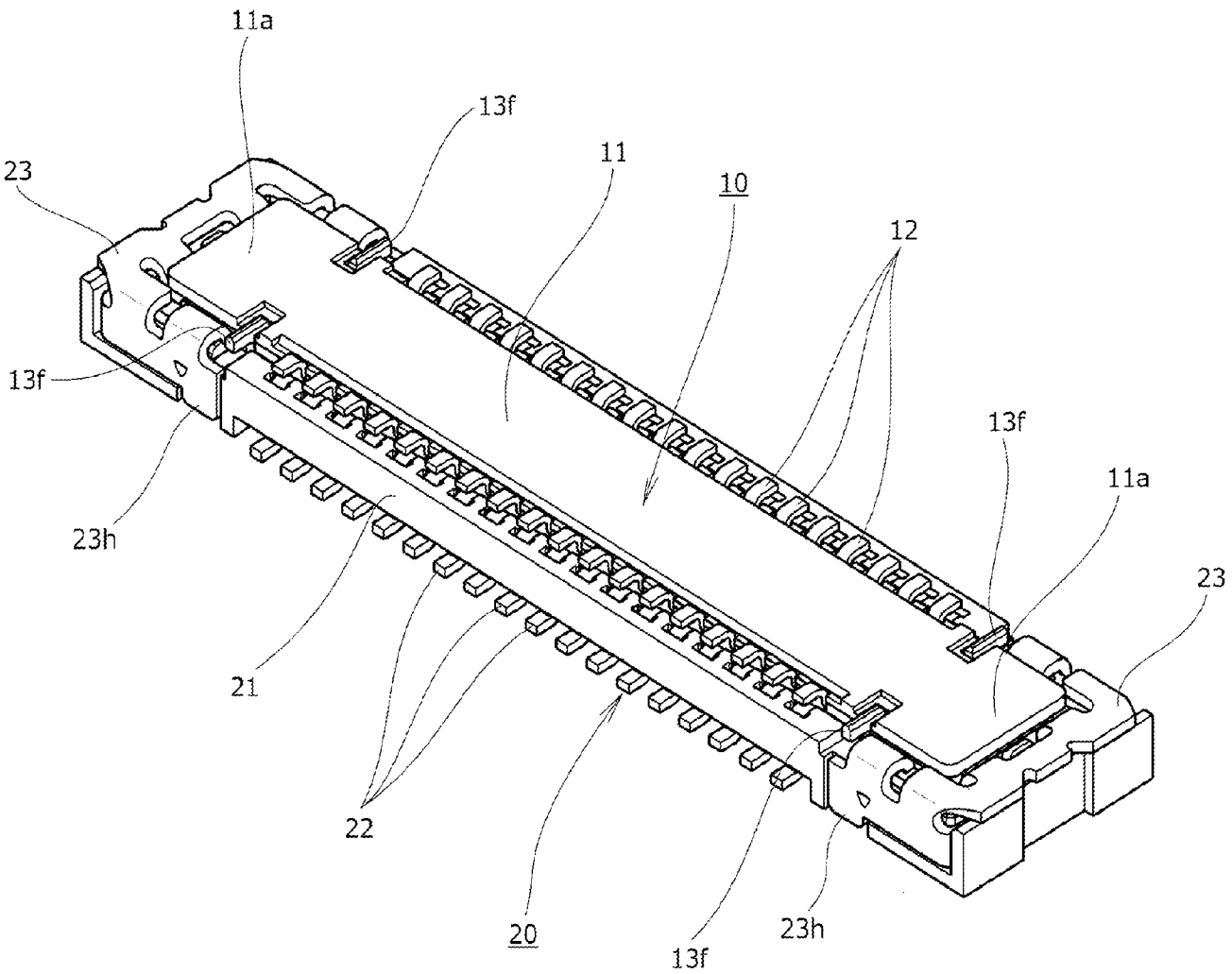
FIG. 18 is an appearance explanatory perspective view showing a state without the first and second printed wiring substrates, wherein the first and second electric connectors have been mutually mated from the state of FIG. 17.
Figure 19:
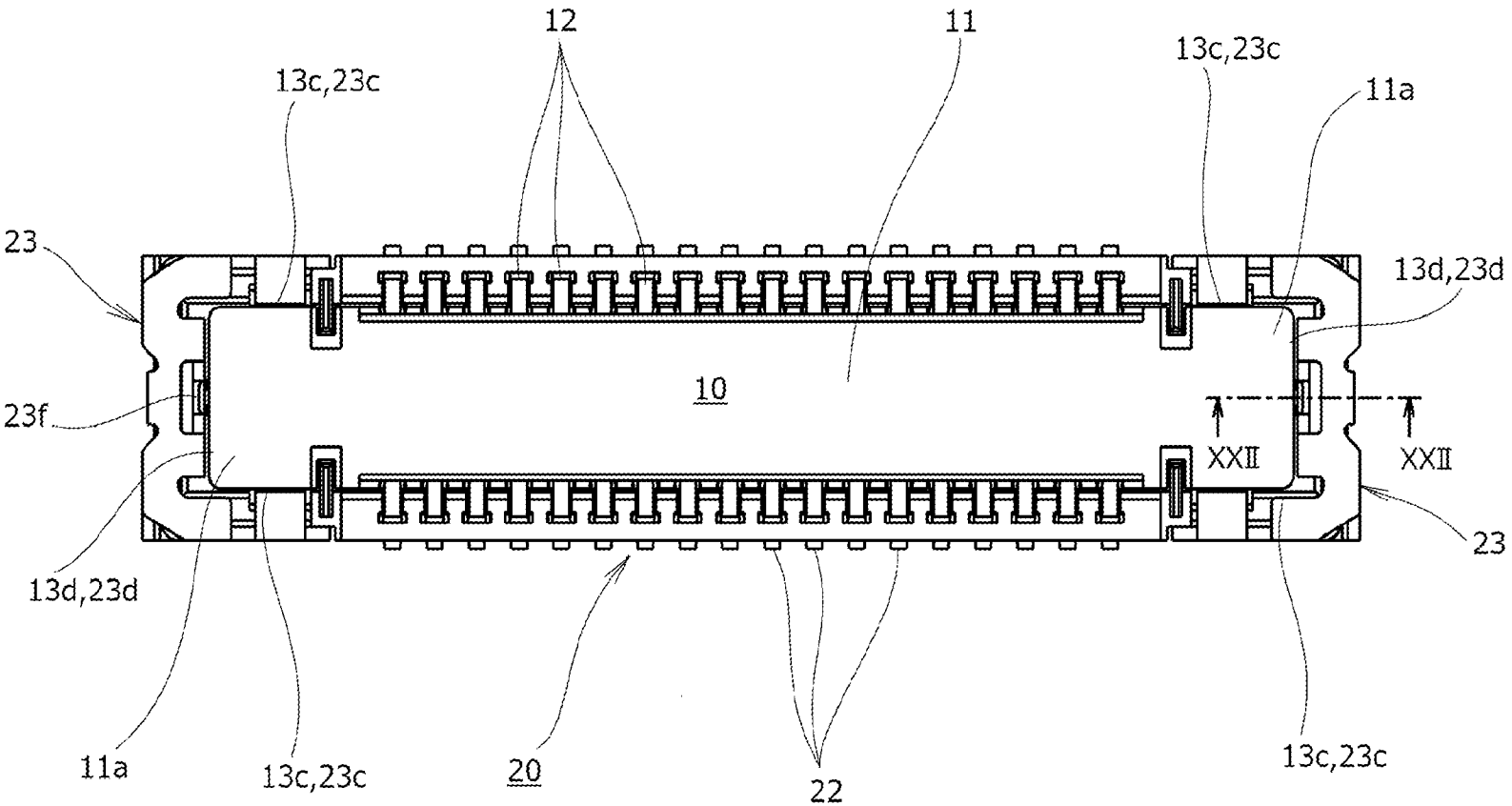
FIG. 19 is an explanatory plan view showing a mutually mated state of the first and second electric connectors shown in FIG. 18.
Figure 20:
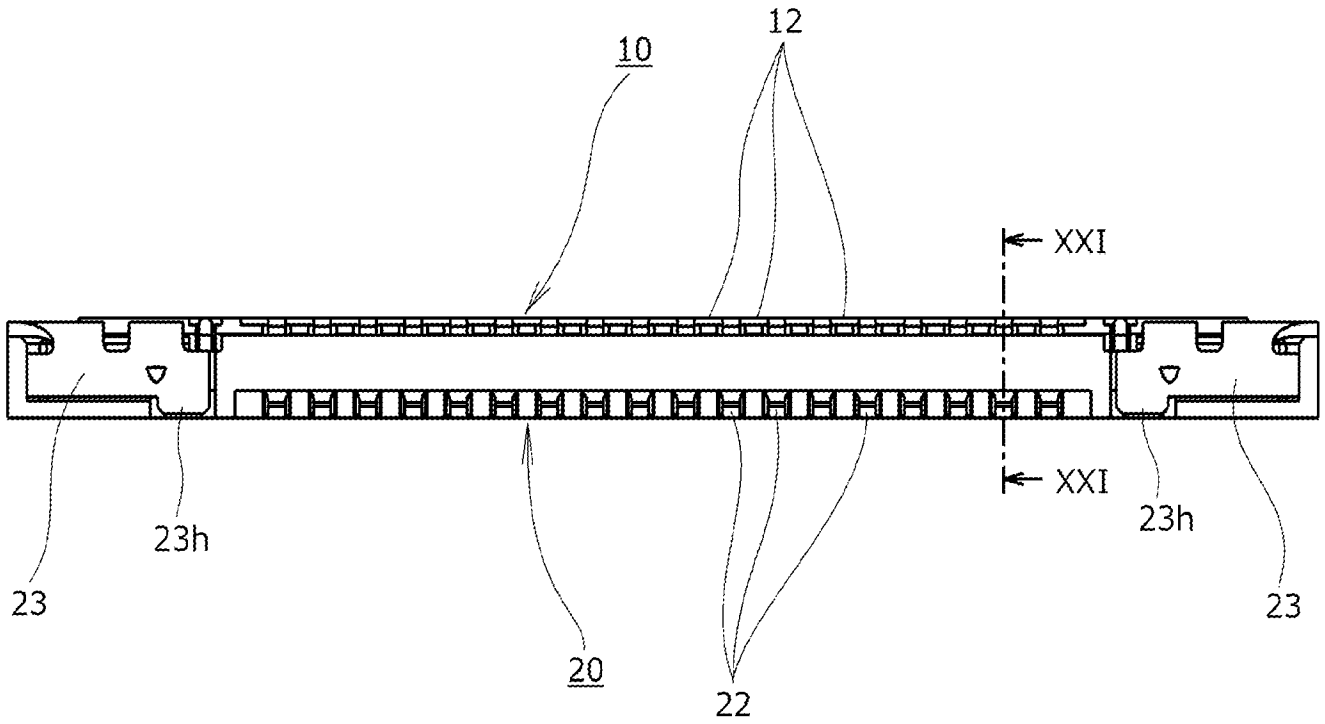
FIG. 20 is an explanatory front view showing the mutually mated state of the first and second electric connectors shown in FIG. 18 and FIG. 19.
Figure 21:
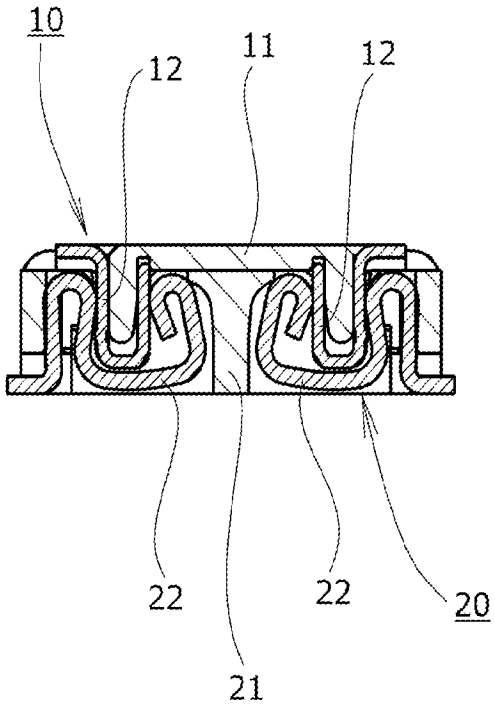
FIG. 21 is an explanatory transverse cross-sectional view taken along a line XXI-XXI in FIG. 20.
Figure 22:
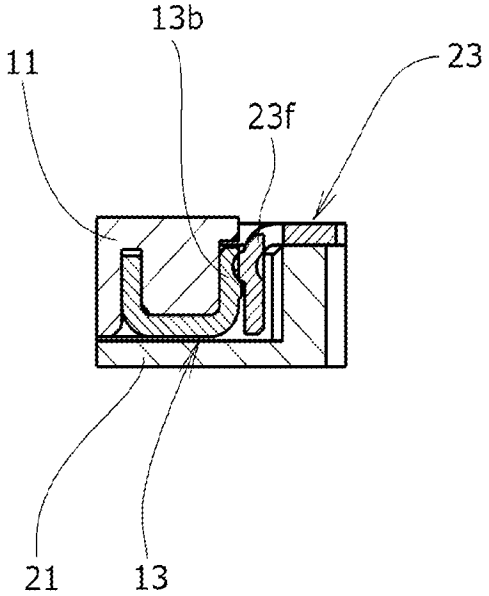
FIG. 22 is an explanatory transverse cross-sectional view taken along a line XXII-XXII in FIG. 19.

In the explanation below, the mating direction of the plug connector (first electric connector) 10 and the receptacle connector (second electric connector) 20 is assumed to be a "top-bottom direction". The plug connector 10 is disposed in the upper side of the receptacle connector 20, which is disposed in a lower side, as shown in FIG. 17, and, in this state, the plug connector 10 is pushed in to a downward direction; as a result, both of the electric connectors 10 and 20 are mutually mated as shown in FIG. 18 to FIG. 22. The plug connector 10 is configured to be removed from the receptacle connector 20 when the plug connector 10 is pulled up upward with appropriate force in such a mating state.

An operation of mating/removing the plug connector (first electric connector) 10 with/from the above described receptacle connector (second electric connector) 20 is not limited to be carried by the hand of an operator, but may be automatically carried out by a predetermined jig or machine.

[About Structure of Electric Connectors]

The plug connector (first electric connector) 10 and the receptacle connector (second electric connector) 20 respectively have insulating housings 11 and 21 having flat-plate frame shapes which form approximately planarly rectangular shapes (rectangular shapes). The insulating housings 11 and 21 are, for example, formed by molding by using a resin material such as plastic, and many contact members 12 and 22 are arranged thereon along the longitudinal direction of the insulating housings 11 and 21 so as to form multipolar shapes. Hereinafter, the longitudinal direction of the insulating housings 11 and 21 will be referred to as "connector longitudinal direction", and the direction orthogonal to the "connector longitudinal direction and the "top-bottom direction" will be referred to as "connector width direction".

As described above, the contact members 12 and 22 are arranged to be multipolar in the "connector longitudinal direction", and, more specifically, the contact members 12 or 22 have two electrode rows symmetrically disposed in the connector width direction. These two electrode rows are juxtaposed so as to be extended approximately in parallel along the "connector longitudinal direction" and are in a relation that, when both of the electric connectors 10 and 20 are mutually mated, the electrode rows of in the side of the contact members 12 and the electrode rows in the side of the contact members 22 are elastically mated with each other.

On the other hand, the plug connector (first electric connector) 10 and the receptacle connector (second electric connector) 20, which have been brought into the mated state in the above described manner, are configured to be regulated to a state in which the mating positions of both of them are appropriate by plug-side mating guide members 13 and counterpart-side mating guide members 23, which will be explained below. A pair of the plug-side mating guide member 13 and the counterpart-side mating guide member 23 is disposed at each of both-side parts of the "connector longitudinal direction" and are formed of bent structures of metal plates, which are attached so as to cover connector-longitudinal-direction both-end parts of the insulating housings 11 and 21. Then, the plug-side mating guide members 13 provided in the side of the plug connector 10 are mated so as to be fitted in inner-side regions of the counterpart-side mating guide members 23 provided in the side of the receptacle connector 20.

[About Plug-Side Mating Guide Members]

Among them, the plug-side mating guide member 13 provided at the plug connector (first electric connector) 10 is formed so as to form a hollow-box-shaped body projecting upward from the surface of the first wiring substrate P1, and the outer surface of the plug-side mating guide member 13 serves as a cover surface covering an outer surface of the insulating housing 11.

As the cover surface of the plug-side mating guide member 13, a cover principal surface 13*a* extending approximately horizontally so as to cover an upper-side surface of the insulating housing 11 from the upper side is provided, and a cover end surface 13*b* disposed so as to cover a longitudinal-direction-distal-end-side upright wall surface of the insulating housing 11 from the outer side and paired cover lateral surfaces 13*c* and 13*c* disposed so as to cover connector-width-direction both-side upright wall surfaces of the insulating housing 11 from the outer side are provided.

Among them, the cover end surface 13*b* and the cover lateral surfaces 13*c* and 13*c* are formed so as to be continuously extended downward from the cover principal surface 13*a*, which is extending approximately horizontally with respect to the first wiring substrate P1 on which the plug connector (first electric connector) 10 is mounted, and a plug-side first guide surface 13*d* is formed at the part continued from the cover principal surface 13*a* toward the cover end surface 13*b*. Moreover, plug-side second guide surfaces 13*e* and 13*e* are formed at the parts continued from the cover principal surface 13*a* toward both of the cover lateral surfaces 13*c* and 13*c*.

The plug-side first guide surface 13*d* and the plug-side second guide surfaces 13*e* and 13*e* are formed so as to be extended to form curved surface shapes having arc shapes in cross section downward from the above described cover principal surface 13*a*. The plug-side first guide surface 13*d* and the plug-side second guide surfaces 13*e* and 13*e* are configured so that, when the plug connector (first electric connector) 10 is mated with the receptacle connector (second electric connector) 20 serving as the counterpart connector, the guide surfaces contact the counterpart-side mating guide member 23, which is provided so as to form part of the later-described receptacle connector 20, from the upper side and easily slide by guiding actions of the surfaces, which form the curved shapes.

Figure 1:
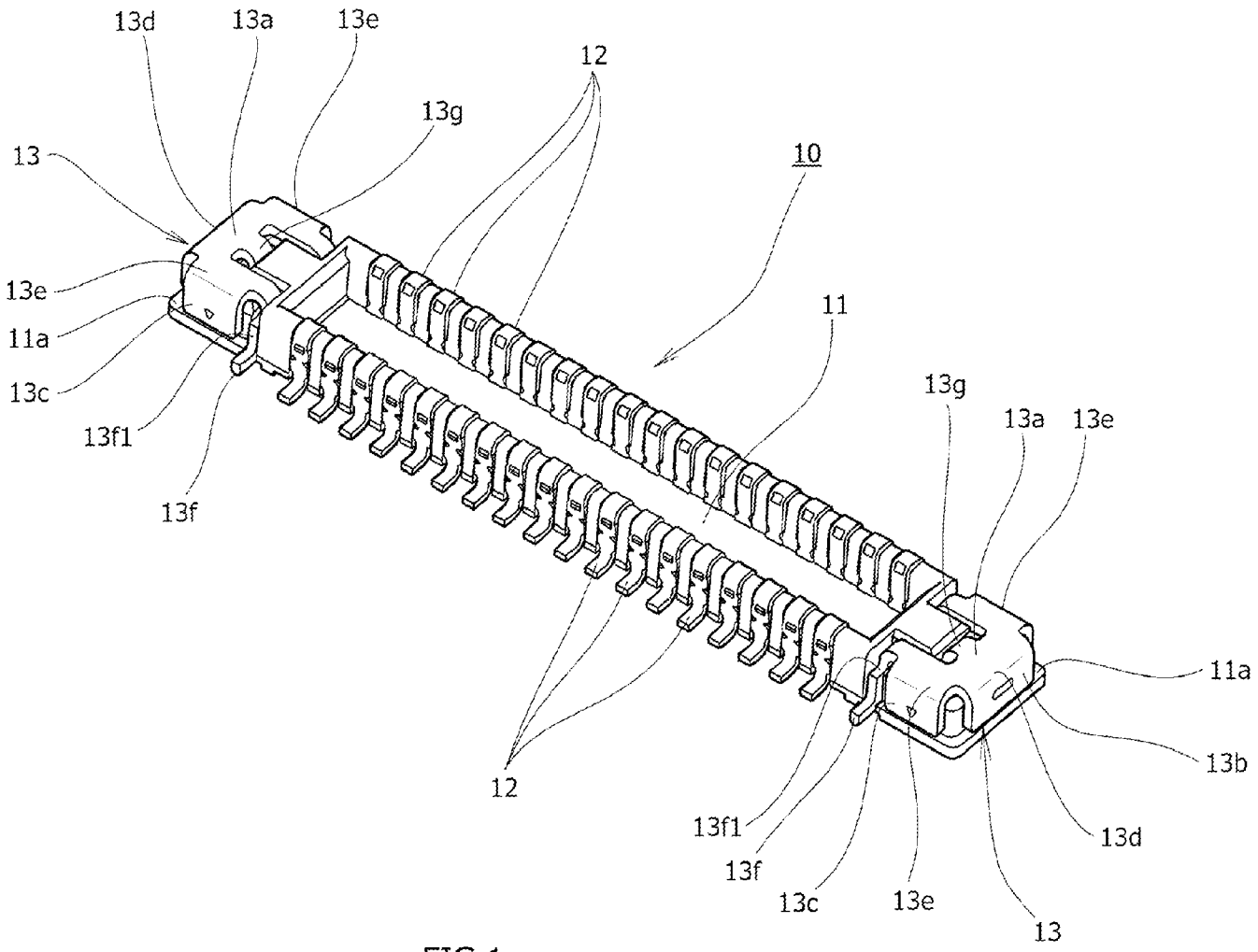
FIG. 1 is an appearance explanatory perspective view showing, from an upper side, a first electric connector (plug connector) according to an embodiment of the present invention.
Figure 2:
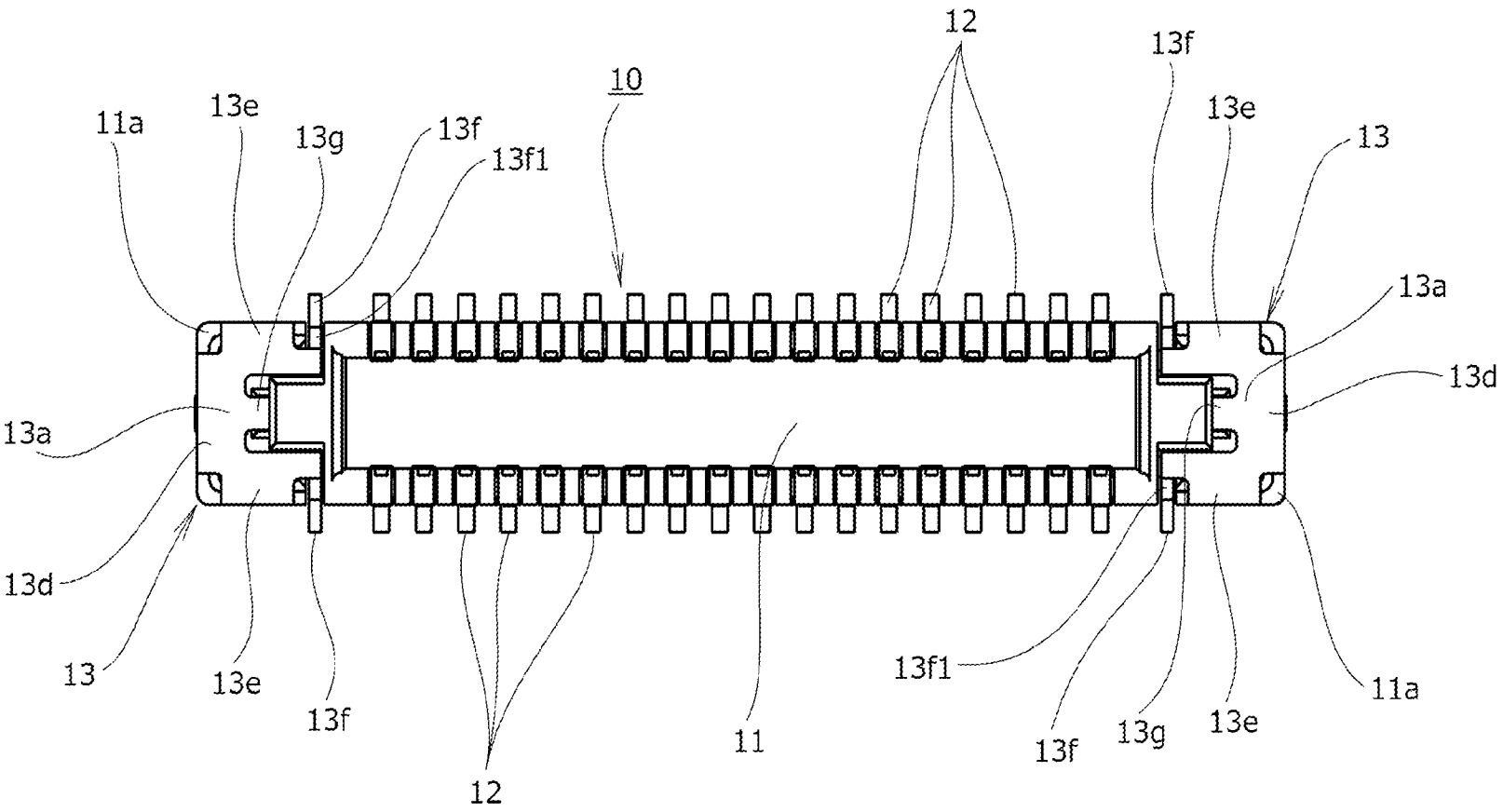
FIG. 2 is an explanatory plan view showing the first electric connector (plug connector) according to the embodiment of the present invention shown in FIG. 1.
Figure 3:
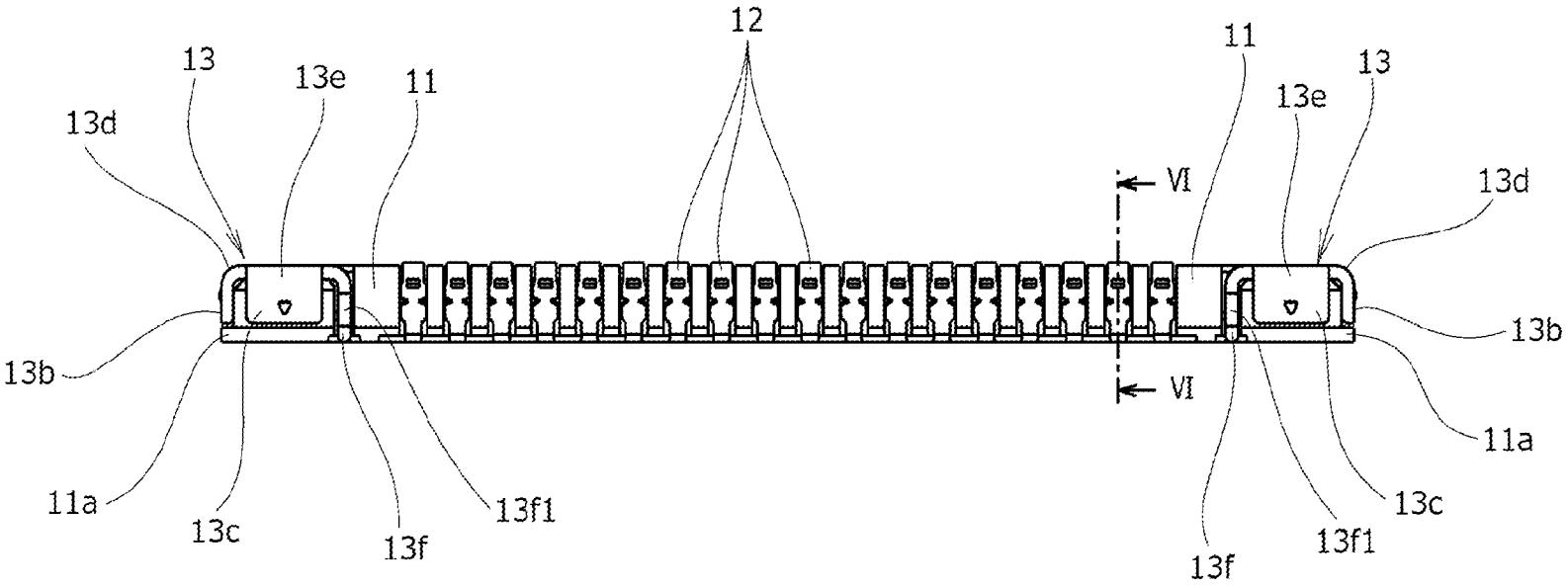
FIG. 3 is an explanatory front view showing the first electric connector (plug connector) according to the embodiment of the present invention shown in FIG. 1 and FIG. 2.
Figure 4:
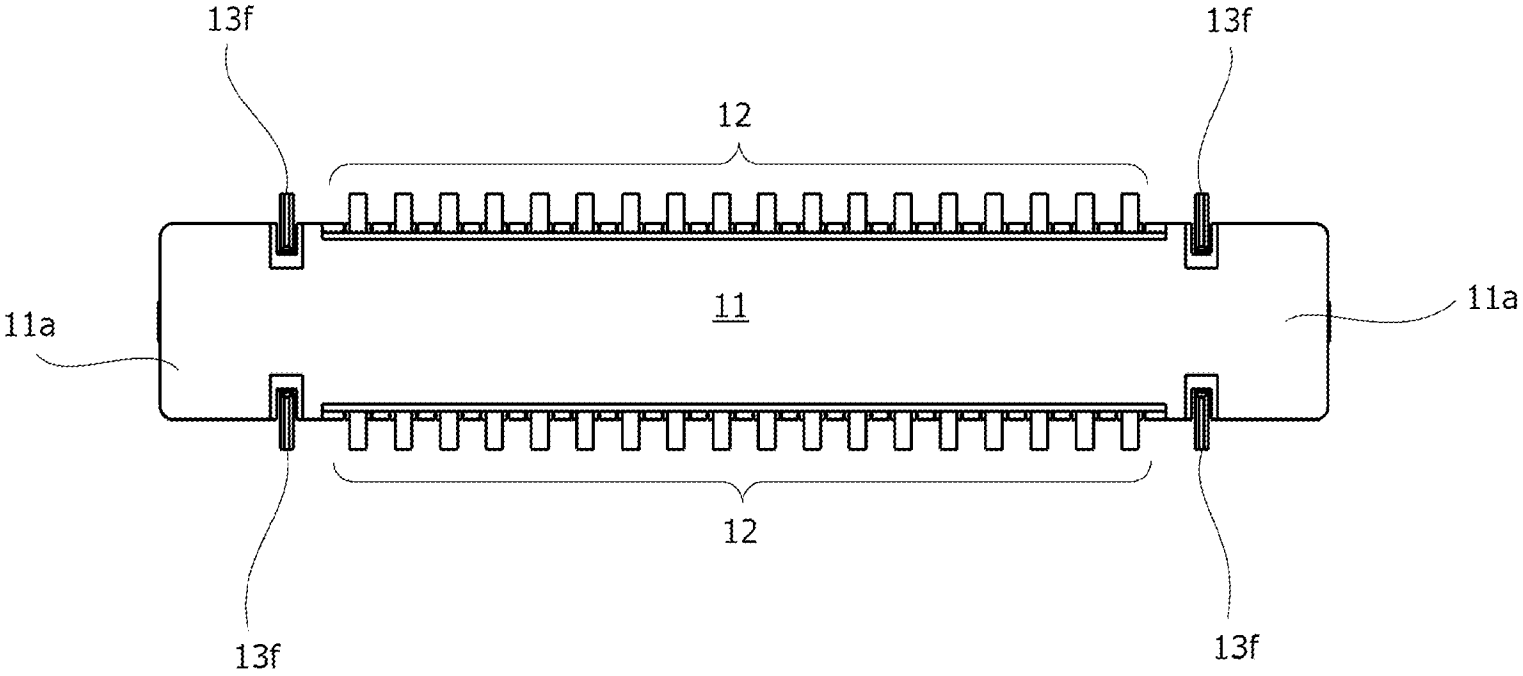
FIG. 4 is an explanatory bottom view showing the first electric connector (plug connector) according to the embodiment of the present invention shown in FIG. 1 to FIG. 3.
Figure 5:
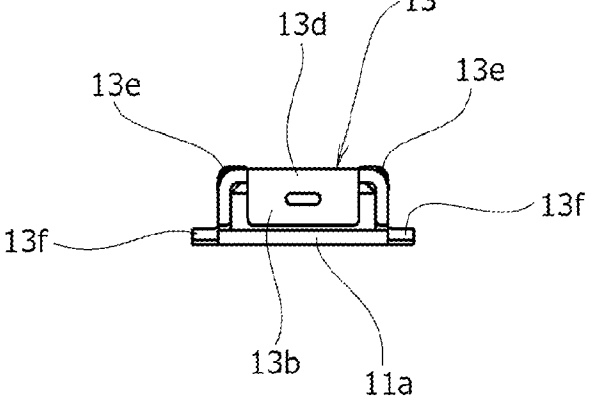
FIG. 5 is an explanatory side view showing the first electric connector (plug connector) according to the embodiment of the present invention shown in FIG. 1 to FIG. 4.
Figure 6:
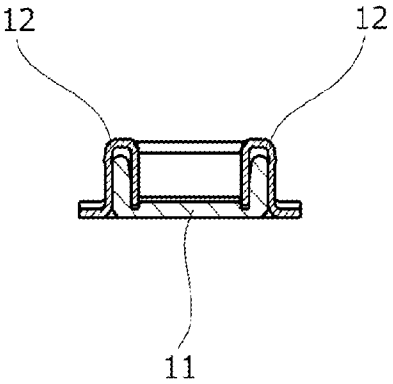
FIG. 6 is an explanatory transverse cross-sectional view taken along a line VI-VI in FIG. 3.
Figure 7A:
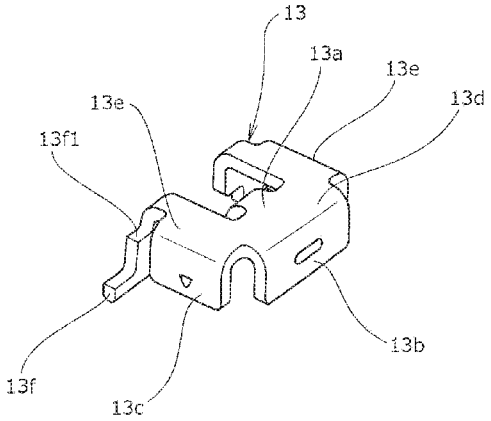
FIG. 7A is an appearance perspective view shown from an outer upper side of the connector.
Figure 7B:
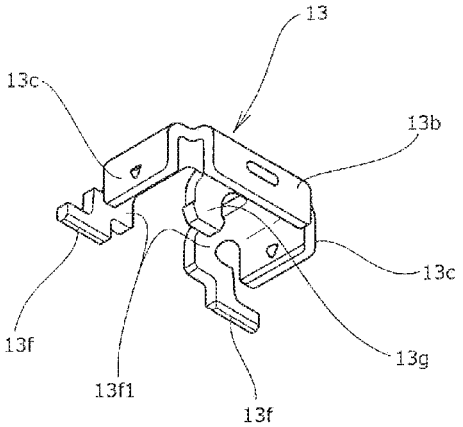
FIG. 7B is an appearance perspective view shown from an outer lower side of the connector.
Figure 7C:
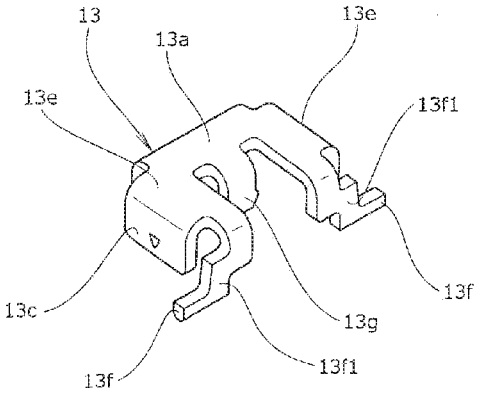
FIG. 7C is an appearance perspective view shown from an inner upper side of the connector.
Figure 7D:
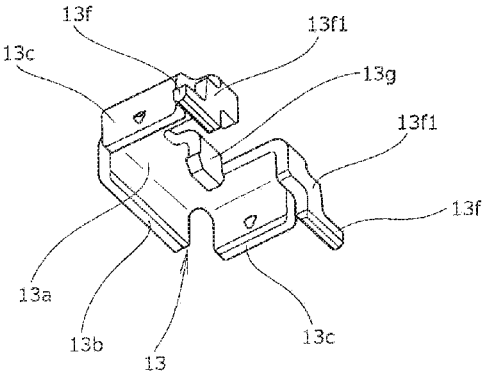
FIG. 7D is an appearance perspective view shown from an inner lower side of the connector.

The plug-side first guide surface 13*d* and the plug-side second guide surfaces 13*e* and 13*e* constituting the plug-side mating guide member 13 like this are formed so as to be continuously extended to form an approximately U-shape in a planar view as shown in FIG. 2, and the guide surfaces are in a disposition relation that the plug-side second guide surfaces 13*e* and 13*e* are extended respectively from both end portions of the plug-side first guide surface 13*d*, which is disposed so as to be extended in the connector width direction, toward the connector inner side (connecter central side). Moreover, a fixing piece 13*g*, which is to be press fitted with the insulating housing 11, is forming a cantilever shape and projecting from a connector-inner-side end edge of the above described cover principal surface 13*a* as shown in FIG. 7C.

In a state in which the plug connector (first electric connector) 10 is mounted on the first wiring substrate P1, the above described plug-side mating guide member 13 is configured so that a connector-longitudinal-direction distal end part (outer end part) of the plug-side mating guide member 13 is projecting toward the outer side from an end edge portion forming the outer shape of the first wiring substrate P1. More specifically, the entirety of the above described cover end surface 13*b* and the plug-side first guide surface 13*d* is in an exposed state in which they are projecting from the first wiring substrate P1 to the outer side, and outer-side end parts of the cover principal surface 13*a*, both of the cover lateral surfaces 13*c* and 13*c*, and the plug-side second guide surfaces 13*e* and 13*e* are in an exposed state in which they are projecting from the first wiring substrate P1 to the outer side. Moreover, a reinforcing plate P1*a* for increasing the strength in a mating operation is attached in a laminated shape onto a back surface side of the first wiring substrate P1.

Figure 8:
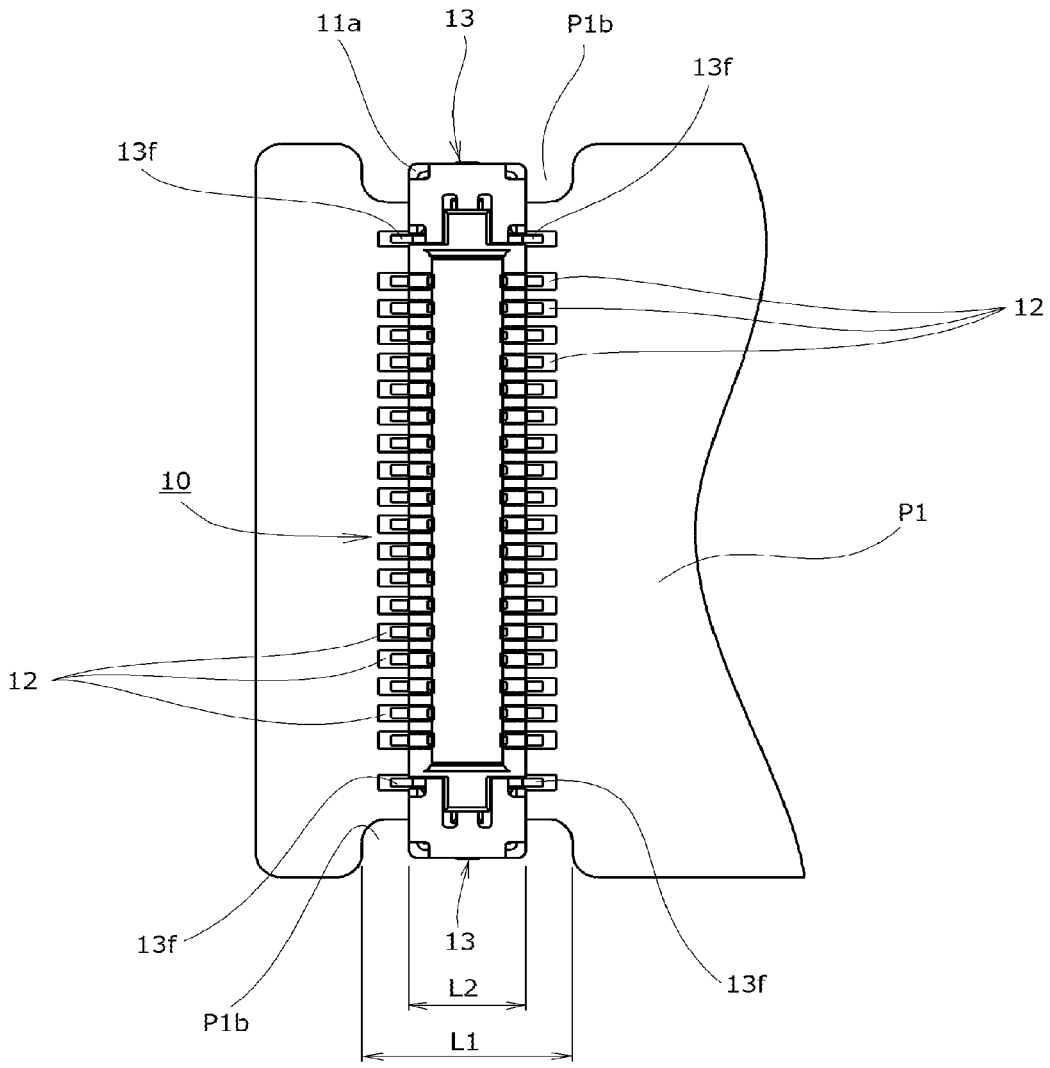
FIG. 8 is an explanatory plan view showing a state in which the first electric connector (plug connector) shown in FIG. 1 to FIG. 7 is mounted on a first printed wiring substrate.
Figure 9:
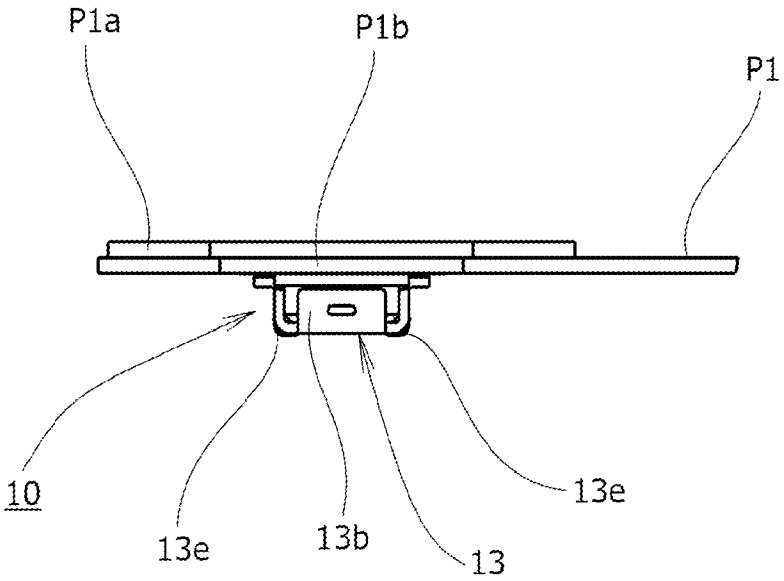
FIG. 9 is an explanatory side view showing the first electric connector (plug connector) in the mounted state shown in FIG. 8.
Figure 10:
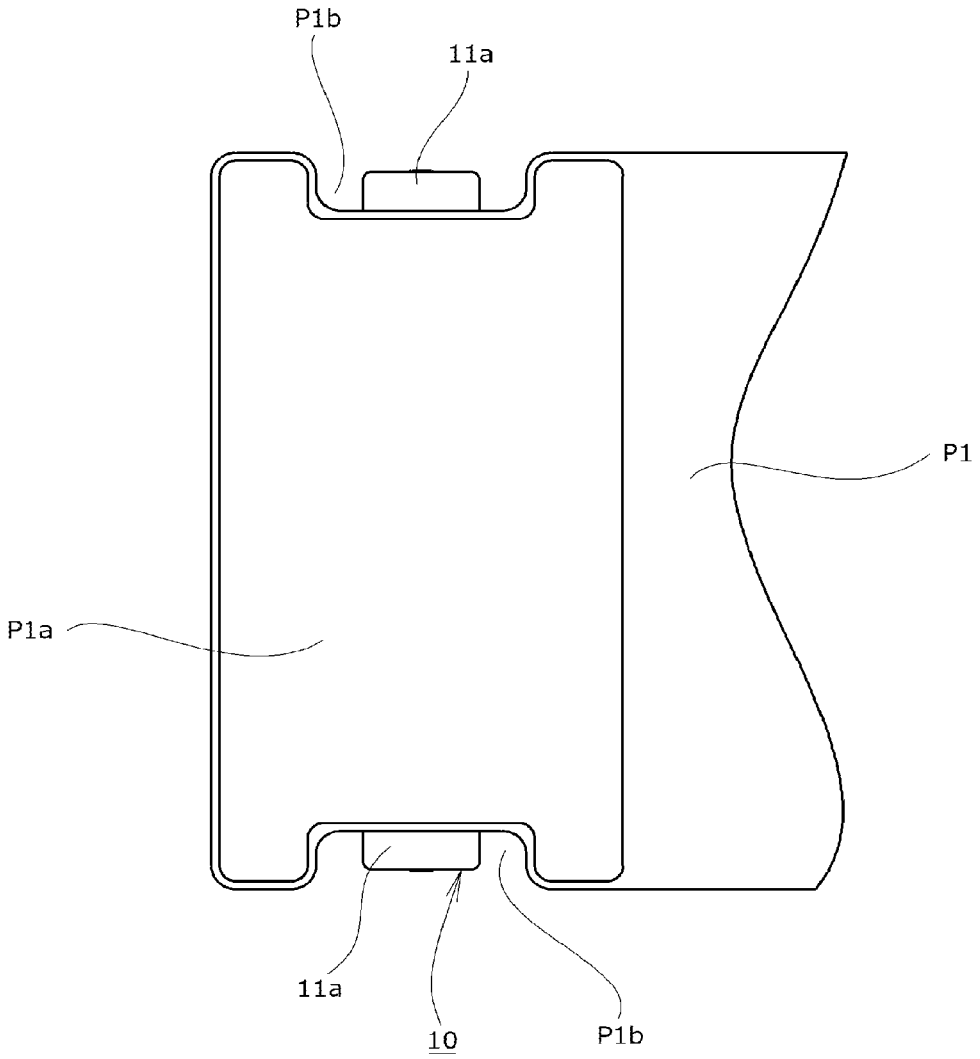
FIG. 10 is an explanatory bottom view showing the first electric connector (plug connector) in the mounted state shown in FIG. 8 and FIG. 9.
Figure 11:
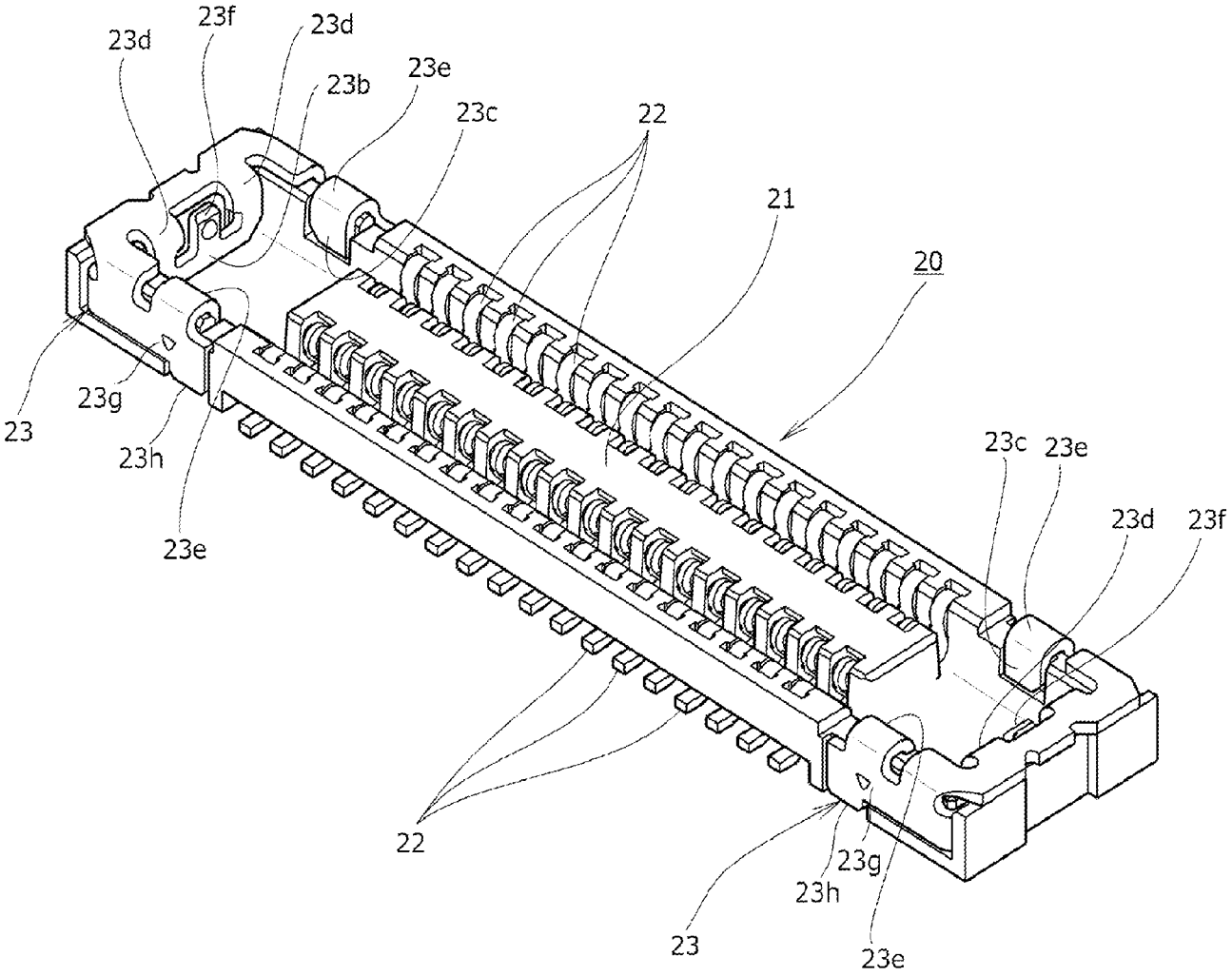
FIG. 11 is an appearance explanatory perspective view showing, from an upper side, a second electric connector (receptacle connector) according to the embodiment of the present invention.

Herein, at both end edges forming the outer shape of the above described first wiring substrate P1, paired cutaway portions P1*b* and P1*b*, which are hollowed toward the connector-width-direction inner side, are formed respectively at the parts at which the plug-side mating guide members 13 of the plug connector (first electric connector) 10 are disposed. These cutaway portions P1*b* are formed so as to form approximately rectangular shapes in plane. Particularly as shown in FIG. 8, a cutaway width l1 of the cutaway portions P1*b* is formed so as to be larger than a connector-width-direction size L2 of the plug connector (first electric connector) 10 so that the entire connector-longitudinal-direction both-end parts of the plug connector 10 are exposed to the outer side through the cutaway portions P1*b*.

Moreover, in the present embodiment, the outer shapes of longitudinal-direction both-end parts 11*a* of the insulating housing 11 are formed so as to be extended along the end-portion outer shape of the above described plug-side mating guide member 13, and the outer shapes of longitudinal-direction both-end parts 11*a* of the insulating housing 11 are in a disposition relation in which the edge parts are overlapped with the edge parts of the cover end surface 13*b* and the cover lateral surfaces 13*c* and 13*c* of the above described plug-side mating guide members 13. The end-portion outer shape of the insulating housing 11 in this case can be formed so as to be extended along a somewhat inner region of the outer shape of the plug-side mating guide member 13. If it is formed in such a manner, the longitudinal-direction both-end parts of the insulating housing 11 can be disposed so as not to project to the outer side from the plug-side mating guide members 13.

Furthermore, substrate connecting portions 13*f*, which are to be solder-joined with the first wiring substrate P1, are integrally provided with the above described plug-side mating guide member 13. The substrate connecting portions 13*f* are formed from part of a plate-shaped member integrally formed by bending part of the plug-side mating guide member 13, and the substrate connecting portions 13*f* are provided so as to be projecting to the outer side from plate-shaped substrates 13*f*1, which rise approximately perpendicularly with respect to the surface of the first wiring substrate P1, in a state in which the plug connector (first electric connector) 10 is mounted on the first wiring substrate P1.

The plate-shaped substrates 13*f*1, which is supporting the substrate connecting portions 13*f* and in a base side, are disposed so as to be extended in the connector width direction, and the substrate connecting portions 13*f* are extended from the plate-shaped substrates f1 so as to form leg shapes toward the outer side of the end edge of the plug connector 10. The narrow lower surfaces corresponding to the plate-thickness parts of the plate-shaped members constituting the substrate connecting portions 13*f* are configured to be solder-joined in a state in which they are in contact with ground-connecting electrically-connecting paths (illustration omitted) formed on the surface of the above described first wiring substrate P1.

[About Counterpart-Side Mating Guide Members]

Figure 12:
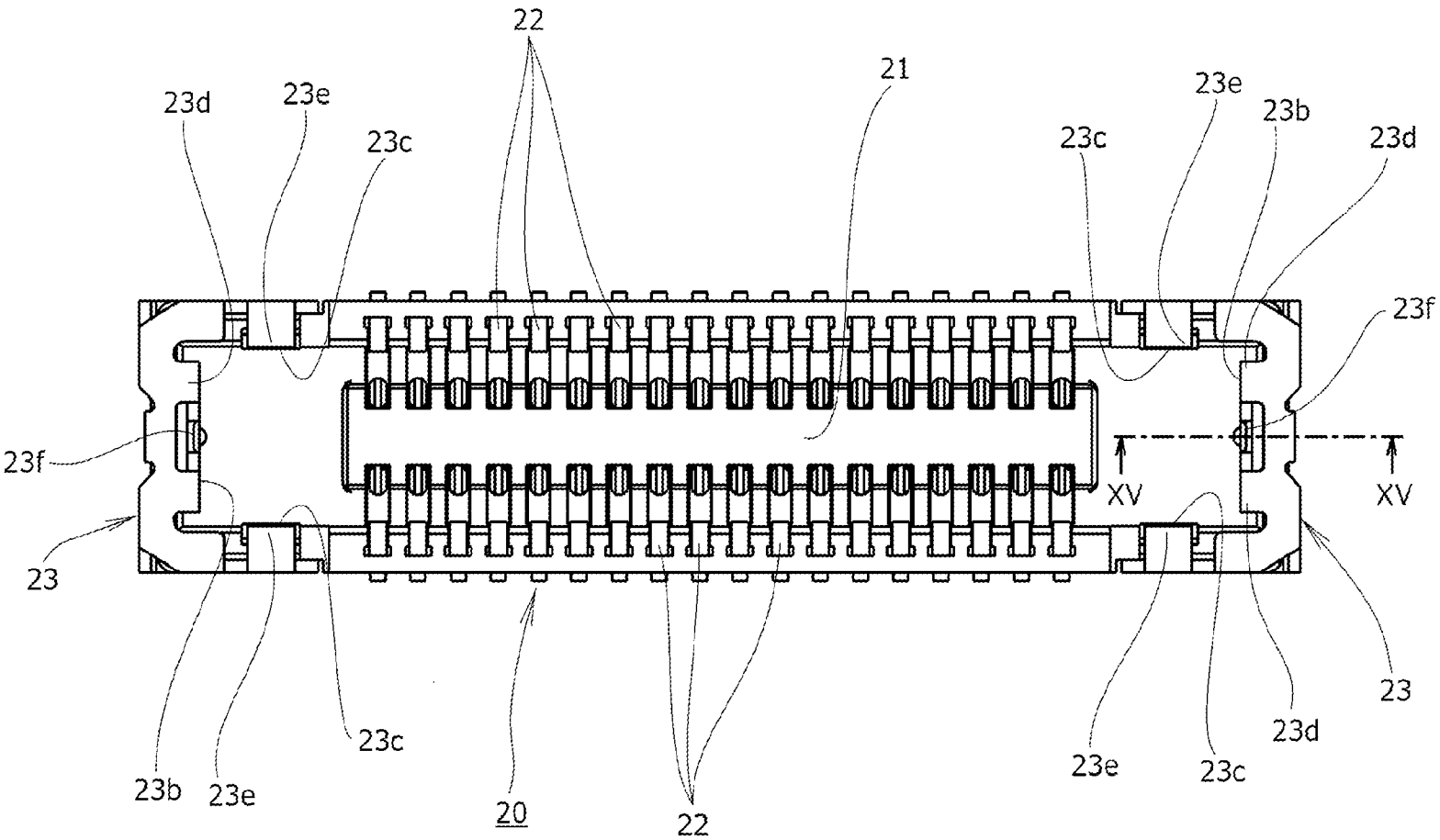
FIG. 12 is an explanatory plan view showing the second electric connector (receptacle connector) according to the embodiment of the present invention shown in FIG. 11.
Figure 13:
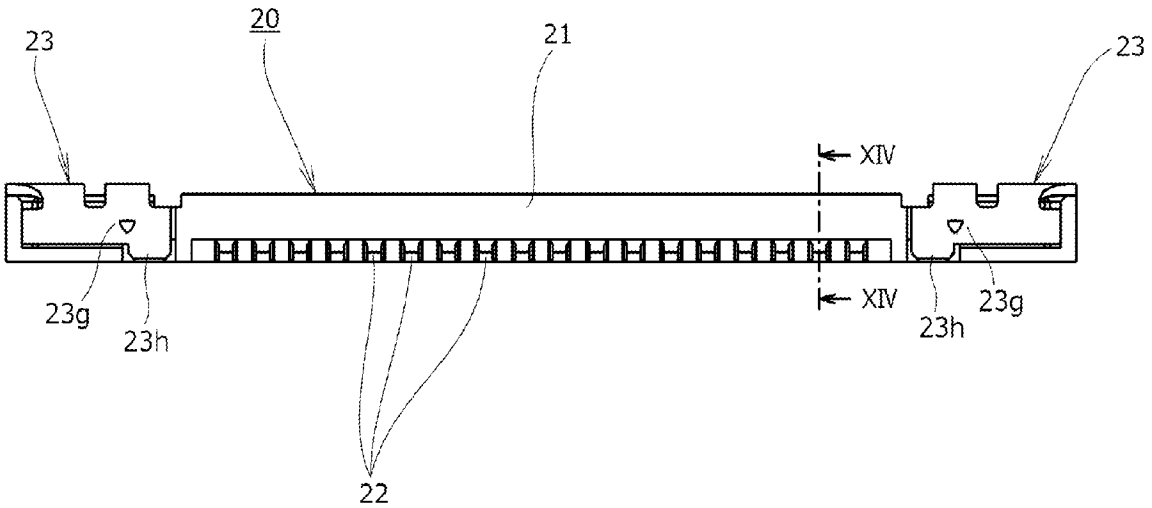
FIG. 13 is an explanatory front view showing the second electric connector (receptacle connector) according to the embodiment of the present invention shown in FIG. 11 and FIG. 12.
Figure 14:
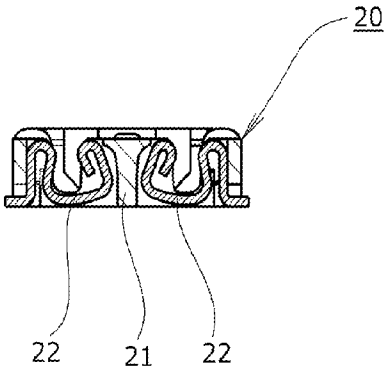
FIG. 14 is an explanatory transverse cross-sectional view taken along a line XIV-XIV in FIG. 13.
Figure 15:
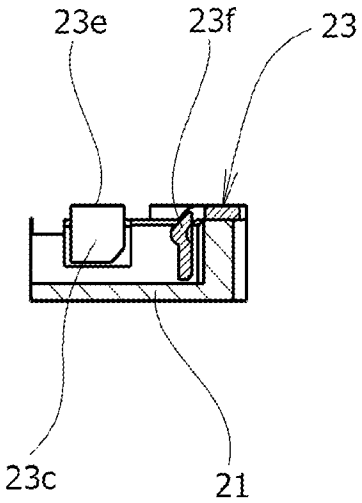
FIG. 15 is an explanatory transverse cross-sectional view taken along a line XV-XV in FIG. 12.
Figure 16A:
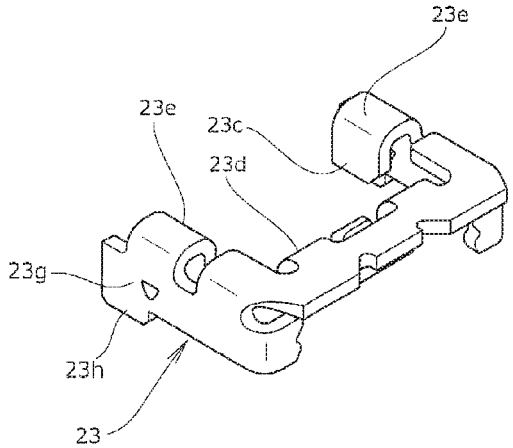
FIG. 16A is an appearance perspective view shown from an outer upper side of the connector.
Figure 16B:
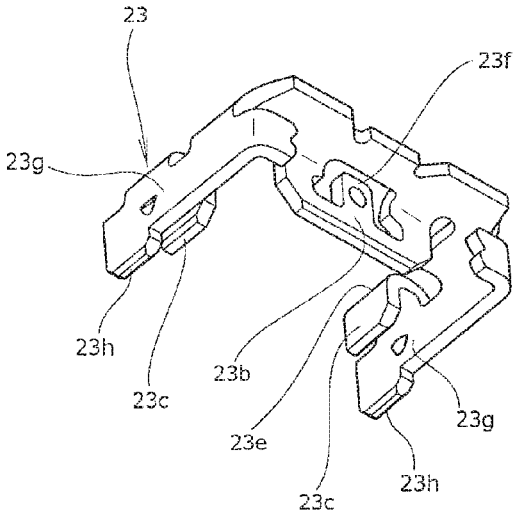
FIG. 16B is an appearance perspective view shown from an outer lower side of the connector.
Figure 16C:
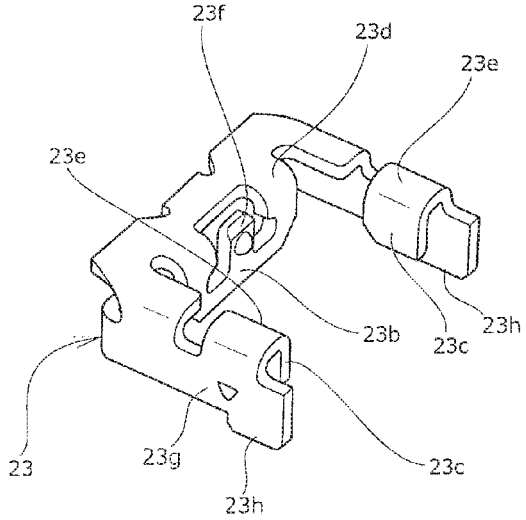
FIG. 16C is an appearance perspective view shown from an inner upper side of the connector.
Figure 16D:
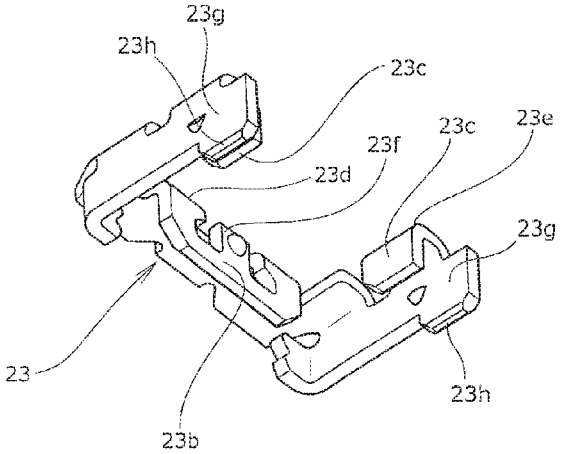
FIG. 16D is an appearance perspective view shown from an inner lower side of the connector.

On the other hand, the receptacle connector (second electric connector) 20 shown in FIG. 11 to FIG. 17 is provided with the counterpart-side mating guide members 23, which are corresponding to the plug-side mating guide members 13 of the above described plug connector (first electric connector) 10. The counterpart-side mating guide members 23 are attached to the connector-longitudinal-direction both-end parts of the insulating housing 21 so as to form approximately U-shapes in a planar view as shown in FIG. 12, and the counterpart-side mating guide members 23 are configured so that the plug-side mating guide members 13 of the above described plug connector (first electric connector) 10 are fitted in and mated with inner-side regions surrounded by the approximately U-shapes of the counterpart-side mating guide members 23.

More specifically, each of the counterpart-side mating guide members 23 provided at the receptacle connector (second electric connector) 20 has an inner wall surface extending so as to form an approximately U-shape in plane along the connector-longitudinal-direction end edge part of the insulating housing 21. The inner wall surface of the counterpart-side mating guide member 23 consists of an end-portion inner wall surface 23*b*, which is disposed so as to extend to downward at approximately right angle from the longitudinal-direction-distal-end-side end edge part of the insulating housing 11, and paired lateral-portion inner wall surfaces 23*c* and 23*c*, which are disposed so as to be extended downward at approximately right angle from the width-direction both end edge parts of the insulating housing 11.

Moreover, at upper end edge parts of the end-portion inner wall surface 23*b* and the paired lateral-portion inner wall surfaces 23*c* and 23*c* described above, a counterpart-side first guide surface 23*d* and counterpart-side second guide surfaces 23*e* and 23*e* are respectively formed. The counterpart-side first guide surface 23*d* and the counterpart-side second guide surfaces 23*e* and 23*e* are formed so as to form curved shapes in cross section at the upper end edge parts of the end-portion inner wall surface 23*b* and the paired lateral-portion inner-wall surfaces 23*c* and 23*c*, and the guide surfaces are configured so that, when the above described plug connector (first electric connector) 10 is mated, the plug-side first guide surface 13*d* and the plug-side second guide surfaces 13*e* and 13*e* provided on the plug-side mating guide members 13 of the plug connector 10 contact them from the upper side and easily slide by the guiding actions of the surfaces of both of them forming curved shapes.

Herein, an elastic tongue 23*f*, which is to elastically contact the cover end surface 13*b* of the plug-side mating guide member 13, is provided on the end-portion inner wall surface 23*b* of the above described counterpart-side mating guide member 23. The elastic tongue 23*f* is formed so as to cut and raise part of the end-portion inner wall surface 23*b* in a cantilever shape and is formed so as to be bulged toward the inner region (connector center) side of the counterpart-side mating guide member 23. There is a positional relation so that the cover end surface 13*b* of the plug-side mating guide member 13 provided at the above described plug connector (first electric connector) 10 is elastically brought into pressure-contact with the elastic tongue 23*f* provided at the receptacle connector (second electric connector) 20 upon connector mating.

On the other hand, in the counterpart-side mating guide member 23, end-portion outer wall surfaces 23*g* facing the outer sides of the above described end-portion inner wall surface 23*b* with a predetermined interval therebetween are provided so as to form upright walls. Lateral wall portions of the insulating housing 21 are sandwiched in the plate thickness direction by the parts between the end-portion inner wall surface 23*b* and the end-portion outer wall surfaces 23*g*, and the sandwiching force thereof causes the counterpart-side mating guide member 23 to be in a fixed state. Substrate connecting portions 23*h* forming a step shape and projecting downward are formed on bottom surface parts of the end-portion outer wall surfaces 23*g*, and the substrate connecting portions 23*h* are configured to be solder-joined in a state in which they are in contact with ground-connecting electrically-conducting paths P2*a* (see FIG. 17) formed on the surface of the second wiring substrate P2.

In this manner, when the cover end surface 13*b* of the plug-side mating guide member 13, which is connected to the ground-connecting electrically-conducting paths (illustration omitted) in the side of the first wiring substrate P1 via the substrate connecting portions 13*f*, is brought into an elastically contacting relation, upon connector mating, with respect to the elastic tongue 23*f* of the counterpart-side mating guide member 23, which is connected to the ground-connecting electrically-conducting paths P2*a* in the side of the second wiring substrate P2 via the substrate connecting portions 23*h*, a ground circuit is formed between the first wiring substrate P1 and the second wiring substrate P2.

In the substrate-connecting electric connector device provided with such a configuration, the outer end parts of the plug-side mating guide members 13 provided at the plug connector (first electric connector) 10 are projecting to the end edge portions forming the outer shape of the first wiring substrate P1, more specifically, to the inner regions of the hollow-shaped parts of the cutaway portions P1*a*; therefore, when the plug connector 10 is to be mated from the upper side of the receptacle connector (second electric connector) 20, the outer end parts of the plug-side mating guide members 13 of the above described plug connector 10 are visually checked together with the outer end parts of the insulating housing 11. As a result, the mating operation can be carried out while the mutual mating position relation of both of the electric connectors 10 and 20 is approximated. When the mating operation is to be completed, the mutual mating position relation of both of the electric connectors 10 and 20 is regulated to a predetermined state by the guiding actions based on sliding of the plug-side first guide surfaces 13*d* and the plug-side second guide surfaces 13*e* and 13*e* formed on the plug-side mating guide members 13 and the counterpart-side first guide surfaces 23*d* and the counterpart-side second guide surfaces 23*e* and 23*e* provided on the counterpart-side mating guide members 23 of the receptacle connector (second electric connector) 20 so that the mutual mating operation of both of the electric connectors 10 and 20 is easily and precisely carried out.

Particularly, in the present embodiment, since the parts corresponding to the three sides of the approximately U-shape in plane formed by the plug-side first guide surface 13*d* and the plug-side second guide surfaces 13*e* and 13*e* are formed of metal, the guiding action of the plug-side mating guide member 13 provided at the plug connector (first electric connector) 10 enables reliable positioning without damaging the connectors even in a state in which the mating positions are somewhat misaligned.

Moreover, the outer shapes of the both end parts of the insulating housing 11 are overlapped with the outer shapes of the plug-side mating guide members 13 so that both of them form the same shapes and are projecting to the outer side of the wiring substrate. Therefore, upon mutual mating of both of the electric connectors 10 and 20, the mutual mating positions of both of the electric connectors 10 and 20 are easily checked by visually checking the both end parts of the insulating housing 11 having the same shapes as the plug-side mating guide members 13.

Furthermore, the plate-shaped members forming the substrate connecting portions 13*f* are disposed so as to rise from the first wiring substrate P1 with the substrate width. Therefore, the bending rigidity against the external force applied to the substrate connecting portions 13*f* upon mating/removal of both of the electric connectors 10 and 20 is improved, and, particularly upon mutual removal of both of the electric connectors 10 and 20, the risk that the substrate connecting portions 13*f* may be peeled off from the first wiring substrate P1 is reduced.

On the other hand, if part of the above described plug connector (first electric connector) 10 and part of the receptacle connector (second electric connector) 20 serving as the counterpart connector are configured to have mutually different colors or hues, the relative positional relation in the mating operation of both of the electric connectors 10 and 20 is immediately visually checked according to the different colors, and the mutual mating operation of both of the electric connectors 10 and 20 is further easily and precisely carried out.

Hereinabove, the invention accomplished by the present inventors has been explained in detail based on the embodiment. However, the present embodiment is not limited to the above described embodiment, and it goes without saying that various modifications can be made within the range not deviating from the gist thereof.

Figure 23:
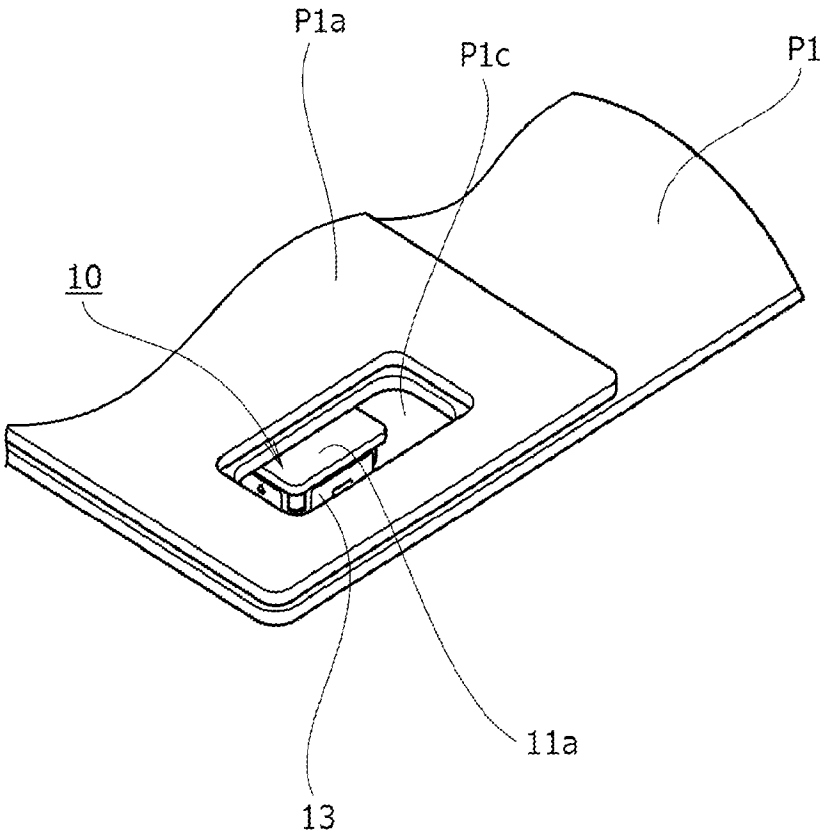
FIG. 23 is an appearance explanatory perspective view showing the structure of a printed wiring substrate according to another embodiment of the present invention.

For example, in the above described embodiment, the cutaway portions P1*b* are provided at the end edge portions forming the outer shape of the first wiring substrate P1 so as to cause the plug connector (first electric connector) 10 to be in the exposed state. However, for example, even when it is configured to be exposed through a through hole P1*c* as shown in FIG. 23, similar working/effects are obtained.

Moreover, in the above described embodiment, the guide surfaces 13*d*, 13*e*, 23*d*, and 23*e* provided on the plug-side mating guide members 13 and the counterpart-side mating guide members 23 are formed by the curved surfaces forming arc shapes in cross section, but can be formed by other tilted surfaces such as flat surfaces tilted so as to form corner shapes.

Furthermore, the recessed/projecting mating relation between the plug-side mating guide member 13 and the counterpart-side mating guide member 23 in the above described embodiment can be disposed in a reversed relation between the receptacle connector 10 and the plug connector 20.

As described above, the present invention can be widely applied to various substrate-connecting electric connector devices used in various electronic/electric devices.

What is claimed is:

1. A substrate-connecting electric connector configured so as to be mated with a counterpart connector in a state in which the electric connector is mounted on a wiring substrate, the substrate-connecting electric connector comprising a mating guide member made of metal, that is attached respectively to both of two end parts in a longitudinal direction of an insulating housing so as to regulate a position of mating with the counterpart connector and is provided so as to provide a portion visually checked in the mating operation by projecting beyond an end edge portion of the wiring substrate;

the mating guide member made of metal, which provides the portion visually checked in the mating operation by projecting beyond the end edge portion of the wiring substrate, has a guide surface that contacts part of the counterpart connector and slides toward a predetermined position upon mating with the counterpart connector, a cover surface continuously extended from the guide surface so as to cover each of said both end parts of the insulating housing; and the cover surface has a cover principal surface that is disposed so as to face the counterpart connector upon mating with the counterpart connector, a cover end surface that covers a longitudinal-direction end surface of the insulating housing, and cover lateral surfaces that cover both of two end surfaces in a housing-width direction of the insulating housing, the housing-width direction being orthogonal to the longitudinal direction of the insulating housing.

2. The substrate-connecting electric connector according to claim 1, wherein the guide surface is formed by a curved surface or a tilted surface.

3. The substrate-connecting electric connector according to claim 1, wherein the guide surface is extended in an approximately U-shape in plane so as to cover each of the longitudinal-direction both end parts of the insulating housing from the outer side.

4. The substrate-connecting electric connector according to claim 3, wherein each of the longitudinal-direction both end parts of the insulating housing is disposed so as to be overlapped with the guide surface; and an outer shape of each of the longitudinal-direction both end parts of the insulating housing is extended along an inner region of an outer shape of the guide surface.

5. The substrate-connecting electric connector according to claim 1, wherein the mating guide member is integrally provided with a substrate connecting portion by bending of the guide member, the substrate connecting portion being solder-joined with the wiring substrate;

the substrate connecting portion is formed so as to form a plate-shaped member rising approximately perpendicularly from a surface of the wiring substrate; and a surface forming a plate thickness of the substrate connecting portion is configured to contact the surface of the wiring substrate.

6. A substrate-connecting electric connector device comprising the substrate-connecting electric connector according to claim 1 and the counterpart connector mated with the substrate-connecting electric connector; wherein the counterpart connector is provided with a counterpart-side mating guide member mated with the mating guide member; and the counterpart-side mating guide member has a counterpart-side guide surface that guides the mating guide member toward an inner-side region of the counterpart-side mating guide member in a plane orthogonal to a direction of mating.

7. The substrate-connecting electric connector device according to claim 6, wherein the counterpart-side mating guide member is provided with an elastic tongue that elastically contacts the mating guide member.

8. The substrate-connecting electric connector device according to claim 6, wherein part of the substrate-connecting electric connector and part of the counterpart connector mated with the substrate-connecting electric connector have mutually different colors or hues.

* * * * *